US008974588B2

(12) United States Patent
Lau et al.

(10) Patent No.: US 8,974,588 B2
(45) Date of Patent: Mar. 10, 2015

(54) COATING COMPOSITION, A PROCESS OF APPLYING A COATING, AND A PROCESS OF FORMING A COATING COMPOSITION

(75) Inventors: Yuk-Chiu Lau, Schenectady, NY (US); Surinder Singh Pabla, Greer, SC (US); David Vincent Bucci, Greenville, SC (US); Paul Mathew, Karnataka (IN); Ronald Ralph Cairo, Greenville, SC (US); Krishnamurthy Anand, Bangalore Karnataka (IN); Guruprasad Sundararajan, Bangalore Karnataka (IN); Mohandas Nayak, Bangalore Karnataka (IN); Eklavya Calla, Bangalore Karnataka (IN)

(73) Assignee: General Electric Company, Schenectady, NY (US)

( * ) Notice: Subject to any disclaimer, the term of this patent is extended or adjusted under 35 U.S.C. 154(b) by 646 days.

(21) Appl. No.: 13/248,105

(22) Filed: Sep. 29, 2011

(65) Prior Publication Data

US 2013/0084399 A1 Apr. 4, 2013

(51) Int. Cl.

| | |
|---|---|
| ***C09D 1/00*** | (2006.01) |
| ***C23C 24/04*** | (2006.01) |
| ***C23C 30/00*** | (2006.01) |
| ***C22C 19/07*** | (2006.01) |
| *C23C 18/16* | (2006.01) |
| *C23C 18/44* | (2006.01) |

(52) U.S. Cl.

CPC ..... *C23C 24/04* (2013.01); *C23C 30/00* (2013.01); *C22C 19/07* (2013.01); *C23C 18/1635* (2013.01); *C23C 18/44* (2013.01)

USPC ..... 106/286.2; 106/286.3; 106/286.4; 106/286.5; 508/103; 508/105; 508/108

(58) Field of Classification Search

USPC ..... 508/200; 106/286.2

See application file for complete search history.

(56) References Cited

U.S. PATENT DOCUMENTS

| | | | | |
|---|---|---|---|---|
| 5,785,775 | A | 7/1998 | Smashey et al. | |
| 5,873,703 | A | 2/1999 | Kelly et al. | |
| 6,408,928 | B1 | 6/2002 | Heinrich et al. | |
| 8,196,600 | B1 * | 6/2012 | Bruce et al. | 137/375 |
| 2007/0240603 | A1 | 10/2007 | Ko et al. | |
| 2008/0102220 | A1 | 5/2008 | Haynes et al. | |
| 2008/0145554 | A1 * | 6/2008 | Ghasripoor et al. | 427/450 |
| 2008/0145649 | A1 | 6/2008 | Mannem et al. | |
| 2009/0155479 | A1 * | 6/2009 | Xiao et al. | 427/451 |
| 2011/0312860 | A1 * | 12/2011 | Mathew et al. | 508/103 |

FOREIGN PATENT DOCUMENTS

EP 2072634 A2 6/2009

OTHER PUBLICATIONS www.alleghenyludlum.com/ludlum/documents/403-12-21.pdf, Technical Data Blue Sheet, Stainless Steel AL 403 Alloy, Trademark of ATI Properties, Inc., Allegheny Ludlum 2000.

* cited by examiner

*Primary Examiner* — Ellen McAvoy

(74) *Attorney, Agent, or Firm* — McNees Wallace & Nurick LLC

(57) ABSTRACT

A coating composition, a process of applying a coating having a coating composition, and a process of forming a coating composition are disclosed. The coating composition includes an alloy and an oxide component comprising nickel oxide. The process of applying the coating includes cold spraying the coating onto the article. The process of forming the coating composition includes blending and milling the alloy with the oxide component.

13 Claims, 1 Drawing Sheet

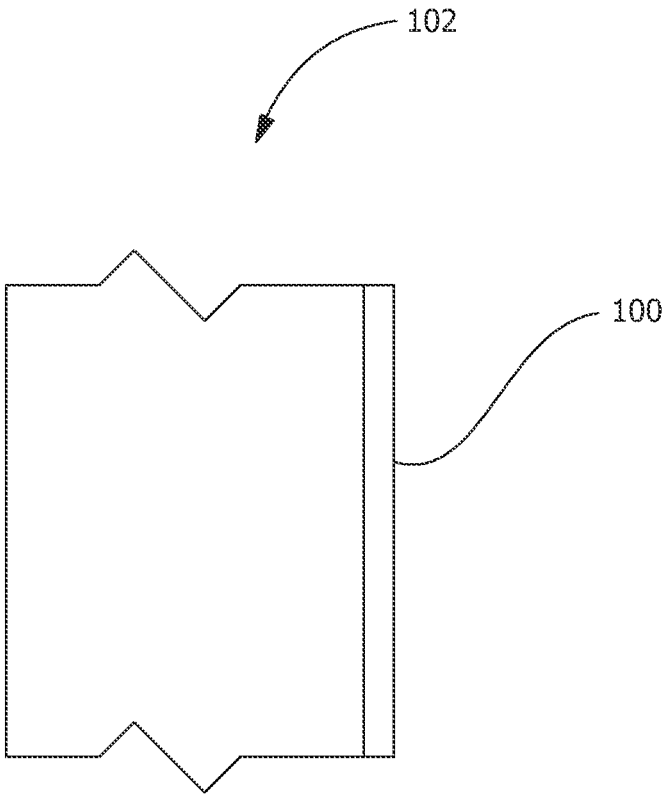
102
100

COATING COMPOSITION, A PROCESS OF APPLYING A COATING, AND A PROCESS OF FORMING A COATING COMPOSITION

FIELD OF THE INVENTION

The present invention is directed to coatings and coating compositions and processes of applying and forming coatings and coating compositions. More specifically, the present invention is directed to sprayed coatings, coating compositions, and processes having an oxide component.

BACKGROUND OF THE INVENTION

Metal components are used in a wide variety of industrial applications, under a diverse set of operating conditions. In many cases, the components are provided with coatings which impart various characteristics. As one example, the various components of turbine engines are often coated with thermal barrier coatings, to effectively increase the temperature at which they can operate. Other examples of articles which require some sort of protective coating include pistons used in internal combustion engines and other types of machines.

Wear-resistant coatings (often referred to as "wear coatings") are frequently used on turbine engine components, such as nozzle wear pads and dovetail interlocks. Such coatings provide protection in areas where components may rub against each other, since the rubbing, especially high frequency rubbing, can damage the part. A specific type of wear is referred to as "fretting." Fretting can often result from very small movements or vibrations at the juncture between mating components, for example, in the compressor and/or fan section of gas turbine engines. For example, fretting can occur in regions where fan or compressor blades are joined to a rotor or rotating disc. This type of wear results in premature repair or replacement of one or more of the affected components. Various alloys, such as those based on nickel or cobalt, are susceptible to fretting and other modes of wear. Many titanium alloys have especially poor anti-fretting characteristics.

Specifically, compressor dovetails in industrial gas turbines can be subject to contact stress, fretting motion, corrosive environments, and combinations thereof. Such factors can decrease the useful life of the dovetails and/or decrease duration between repairs.

Known processes repair and/or protect dovetails by applying dry film lubricating systems having coarse lubricating particles embedded in an epoxy binder or a spray baked inorganic binder. Such dry film lubricating systems have limited life due to poor integrity of low temperature cured binders, large lubricating particles that can be pulled out, leading to coating wear and direct exposure to base metal; this also can lead to limited corrosion protection. In coatings with an undesirable degree of wear resistance, pitting damage can occur due to crevice corrosion either because the coatings are not protective enough or uncoated components, such as blades are used. Such damage can result in accrued fretting fatigue damage that can result from cracks being nucleated and propagated leading to damage to an overall system such as a gas turbine.

Other known processes have failed to provide a desirable degree of wear resistance, and lubrication.

A coating composition, a process of applying a coating, and a process of forming a coating composition not suffering from one or more of the above drawbacks would be desirable in the art.

BRIEF DESCRIPTION OF THE INVENTION

In an exemplary embodiment, a coating composition includes an alloy, an oxide component comprising nickel oxide, and lubricating particles. In this embodiment, the alloy is selected from the group consisting of cobalt-based alloys, aluminum bronze alloys, and combinations thereof.

In another exemplary embodiment, a process of applying a coating onto an article includes providing a coating having a coating composition and cold spraying the coating onto the article. In this embodiment, the coating composition comprises an alloy and an oxide component and the oxide component comprises nickel oxide.

In another exemplary embodiment, a process of forming a coating composition includes blending and milling an alloy with an oxide component. In this embodiment, the oxide component comprises nickel oxide.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

FIG. 1 is a side view of a portion of an article having a coating formed by application of coating compositions according to the disclosure.

Wherever possible, the same reference numbers will be used throughout the drawings to represent the same parts.

DETAILED DESCRIPTION OF THE INVENTION

Provided is a coating composition, a process of applying a coating, and a process of forming a coating composition. Embodiments of the present disclosure provide resistance to contact stress, provide resistance to fretting damage and/or fretting induced fatigue damage, provide resistance to corrosive environments, extend the useful life of articles having the coating, increase the duration between repairs, reduce wear, reduce friction, reduce propensity for rotor imbalance, and combinations thereof.

A coating 100 capable of being applied to an article 102 is disclosed. The coating 100 is applied directly or indirectly, for example, on an intermediate layer. In one embodiment, the article 102 is a dovetail for a turbine such as a gas turbine. In a further embodiment, the coating 100 reduces or eliminates crack generation at a stick slip interface of the dovetail. Other suitable articles 102 include, but are not limited to, buckets, nozzles, blades, rotors, vanes, stators, shrouds, combustors, pistons, bushings, and blisks. The article 102 is part of any suitable system, such as, a turbine (for example, land-based turbines, marine turbines, and/or aeronautical turbines), or a non-turbine application (for example, an internal combustion engine).

The article 102 includes any suitable material capable of having the coating 100 applied to it or an intermediate layer applied to it. In one embodiment, the article 102 includes an article alloy. A suitable article alloy has a composition, by weight, of about 15.5% Cr, about 6.3% Ni, about 0.8% Mo, about 1.5% to about 4.0% Cu, about 0.7% Nb, about 0.4% Mn, about 0.03% C, a balance Fe, and inevitable impurities. Another suitable article alloy has a composition, by weight, of about 15.5% Cr, about 6.59% Ni, about 1.92% Mo, about 1.5% to about 4.0% Cu, about 0.7% Nb, about 0.4% Mn, about 0.03% C, a balance Fe, and inevitable impurities. Another suitable article alloy has a composition, by weight, of up to about 0.15% C, up to about 0.5% Mn, about 12.00% Cr, up to about 0.2% Nb, a balance Fe, and inevitable impurities.

The coating 100 provides desired features and characteristics, such as, a predetermined wear resistance, a predetermined coefficient of friction and/or lubricity, a predetermined amount of corrosion resistance, an anodic relationship with the article alloy, operability under a predetermined contact stress, or combinations thereof. When the coating 100 is applied under predetermined conditions, for example, by being cold sprayed, the coating 100 has a coefficient of friction of less than about 0.43 and a wear rate of less than about 0.0005 $N/mm^3$. In further embodiments, the coefficient of friction is about 0.23, is between about 0.07 and about 0.43, is between about 0.14 and about 0.43, is between about 0.14 and about 0.32, or combinations and sub-combinations thereof. Additionally or alternatively, the wear rate is about 0.0001 $N/mm^3$, between about 0.0001 $N/mm^3$ and about 0.0003 $N/mm^3$, between about 0.00001 $N/mm^3$ and about 0.00015 $N/mm^3$, or combinations and sub-combinations thereof. Additionally or alternatively, the predetermined contact stress is greater than about 30 ksi, with further embodiments being greater than about 35 ksi, greater than about 40 ksi, between about 30 ksi and about 40 ksi, between about 30 ksi and about 35 ksi, or combinations and sub-combinations thereof.

The coating 100 has a coating composition. The coating composition forms the coating 100 when the coating 100 is applied to the article 102. The coating composition includes an alloy, an oxide component, and lubricating particles. In one embodiment, the coating composition is substantially devoid of silver. The alloy is selected to provide wear resistance and compatibility with the article 102, the intermediate layer between the article 102 and the coating 100, or other suitable components such as CrMoV steel discs. The alloy is selected from the group consisting of cobalt-based alloys, aluminum bronze alloys, and combinations thereof. For example, in one embodiment, the cobalt-based alloy is or includes $Co_{28}Mo_8Cr_2Si$, $Co_{28}Mo_{17}Cr_2Si$, or combinations thereof.

In one embodiment, the alloy is operable within a temperature range corresponding to the environment of the coating 100 on the article 102. For example, a suitable alloy for a temperature range of less than about 400° F. is aluminum bronze or CuNiIn, with further temperature ranges being between about 200° F. and about 400° F., between about 300° F. and about 400° F., between about 350° F. and about 400° F., or combinations and sub-combinations thereof. A suitable alloy for a temperature range of between about 400° F. and about 800° F. is $Co_{28}Mo_8Cr_2Si$, with further temperature ranges being between about 400° F. and about 600° F., between about 400° F. and about 500° F., and between about 400° F. and about 450° F., between about 500° F. and about 800° F., between about 600° F. and about 800° F., between about 700° F. and about 800° F., or combinations and sub-combinations thereof. A suitable alloy for a temperature range of greater than about 800° F. is $Co_{28}Mo_{17}Cr_2Si$, with further temperature ranges being between about 800° F. and about 1000° F., between about 800° F. and about 900° F., between about 900° F. and about 1000° F., or combinations and sub-combinations thereof.

The amount or volume of the alloy provides predetermined properties. In one embodiment, the alloy forms, by volume, between about 5% and about 95% of the coating composition. In further embodiments, the alloy forms between about 10% and about 90% of the coating composition, between about 20% and about 90% of the coating composition, between about 30% and about 90% of the coating composition, between about 40% and about 90% of the coating composition, between about 50% and about 90% of the coating composition, between about 60% and about 90% of the coating composition, between about 70% and about 90% of the coating composition, between about 80% and about 90% of the coating composition, between about 10% and about 20% of the coating composition, between about 10% and about 30% of the coating composition, between about 10% and about 40% of the coating composition, between about 10% and about 50% of the coating composition, between about 10% and about 60% of the coating composition, between about 10% and about 70% of the coating composition, between about 10% and about 80% of the coating composition, or combinations and sub-combinations thereof.

The nickel oxide component provides lubricity, local anodic sites through redox reactions, and/or combinations thereof. The oxide component includes nickel oxide. In one embodiment, the oxide component further includes titanium oxide, boron oxide, or combinations thereof. The oxide component forms, by volume, between about 5% and about 30% of the coating composition. In further embodiments, the oxide component forms between about 10% and about 30% of the coating composition, between about 15% and about 30% of the coating composition, between about 20% and about 30% of the coating composition, between about 25% and about 30% of the coating composition, between about 5% and about 10% of the coating composition, between about 5% and about 15% of the coating composition, between about 5% and about 20% of the coating composition, between about 5% and about 25% of the coating composition, or combinations and sub-combinations thereof.

It is desirable to control the particle size range of the oxide component, for example, of nickel oxide. In one embodiment, the particle size is maintained fine because coarse lubricating particulates when pulled out can leave behind a large surface porosity which can act as the nucleus for accelerated wear. In one embodiment, the oxide component has a particle size range, for example, between about 10 nm and about 500 nm, between about 10 nm and about 20 nm, between about 10 nm and about 30 nm, between about 10 nm and about 40 nm, between about 10 nm and about 50 nm, between about 10 nm and about 100 nm, between about 10 nm and about 200 nm, between about 10 nm and about 300 nm, between about 10 nm and about 400 nm, between about 400 nm and about 500 nm, between about 300 nm and about 500 nm, between about 200 nm and about 500 nm, between about 100 nm and about 500 nm, or combinations and sub-combinations thereof.

The lubricating particles are selected to provide further reduction in the coefficient of friction beyond that which is imparted by the oxide component. The lubricating particles include hexagonal boron nitride, graphite, molybdenum disulfide, tungsten sulfide, cryolite, calcium difluoride, barium difluoride, mica, talc, calcium sulfate, polytetrafluoroethylene, or combinations thereof. The lubricating particles form, by volume, between about 5% and about 20% of the coating composition. In further embodiments, the lubricating particles form between about 10% and about 20% of the coating composition, between about 15% and about 20% of the coating composition, between about 5% and about 15% of the coating composition, between about 5% and about 10% of the coating composition, or combinations and sub-combinations thereof.

The lubricating particles have a particle size range between about 50 nm and about 1000 nm, with further embodiments being between about 100 nm and about 1000 nm, about 150 nm and about 1000 nm, about 200 nm and about 1000 nm, about 250 nm and about 1000 nm, about 300 nm and about 1000 nm, about 350 nm and about 1000 nm, about 400 nm and about 1000 nm, about 500 nm and about 1000 nm, about 600 nm and about 1000 nm, about 700 nm and about 1000 nm, about 800 nm and about 1000 nm, about 900 nm and about 1000 nm, about 50 nm and about 900 nm, about 50 nm and about 800 nm, about 50 nm and about 700 nm, about 50 nm and about 600 nm, about 50 nm and about 500 nm, about 50 nm and about 400 nm, about 50 nm and about 300 nm, about 50 nm and about 200 nm, about 50 nm and about 100 nm, or combinations and sub-combinations thereof.

In one embodiment, the coating composition further includes hard particles having a predetermined hardness, such as refractory ceramics. The hard particles provide resistance to counterface wear. As used herein, the terms "hard" and "hardness" refer to a measurement on the Mohs scale. In embodiments of the present disclosure, the predetermined hardness is greater than about 7, greater than about 8, greater than about 9, between about 7 and about 10, between about 8 and about 10, between about 9 and about 10, between about 8 and about 9, between about 8.5 and about 9.5, between about 9.0 and about 9.5, between about 9.5 and about 10, or combinations and sub-combinations thereof. In one embodiment, the particles are tungsten carbide, titanium carbide, chromium carbide, or combinations thereof.

In one embodiment, the hard particles have a predetermined particle size range. Suitable particle size ranges are less than about 500 nm, less than about 400 nm, less than about 300 nm, less than about 200 nm, between about 200 nm and about 500 nm, between about 300 nm and about 500 nm, between about 400 nm and about 500 nm, or combinations and sub-combinations thereof.

The exemplary coating composition is applied to the article 102 thereby forming the coating 100 according to any suitable application process. Non-limiting examples include plasma deposition (for example, ion plasma deposition, vacuum plasma spraying (VPS), low pressure plasma spray (LPPS), and plasma-enhanced chemical-vapor deposition (PECVD)), high velocity oxygen fuel (HVOF) techniques, high-velocity air-fuel (HVAF) techniques, physical vapor deposition (PVD), electron beam physical vapor deposition (EBPVD), chemical vapor deposition (CVD), air plasma spray (APS), cold spraying, and laser ablation. In one embodiment, the coating 100 is applied by a thermal spray technique (for example, VPS, LPPS, HVOF, HVAF, APS, and/or cold-spraying).

In one embodiment, the application process includes cold spraying the coating 100 onto the article 102. By cold spraying, the coating 100 substantially maintains the microstructure of the coating composition by applying the coating 100 through a shot-peening type of process inducing compressive residual stresses. In one embodiment, the cold spraying permits the article 102 to be operated under greater crush stresses. In further embodiments, the cold spray includes using a carrier gas (for example, helium), forming dense and adherent coatings, cleaning the article 102 or using a cleaned substrate on the article 102, heat treating the applied coating 100, repairing the article 102 by the application of the coating 100, and combinations thereof. In one embodiment, the coating 100 is applied without grit blasting, which can be harmful to the substrate. In another embodiment, the coating 100 is applied without the addition of heat during the application process, thereby permitting the inclusion of certain compounds in the coating composition that were not previously available, such as sulfide based lubricating particles.

The exemplary coating composition is formed by any suitable fabrication process. In one embodiment, the fabrication process includes blending and milling the alloy with the oxide component. The blending and milling is for a predetermined period, for example, up to about 12 hours. The milling is any suitable milling process capable of milling the portions of the coating composition to a predetermined particle size. Suitable milling processes include, but are not limited to, mechanical milling, ball milling, high energy ball milling, ball milling under a heat treatment, rack liquid milling, and combinations thereof. Suitable particle sizes include, but are not limited to, between about 1 micron and about 10 microns, between about 3 microns and about 10 microns, between about 5 microns and about 10 microns, between about 7 microns and about 10 microns, between about 1 micron and about 2 microns, between about 1 micron and about 3 microns, between about 1 micron and about 5 microns, between about 1 micron and about 7 microns, or combinations and sub-combinations thereof. In further embodiments, the other portions of the coating composition described above are also blended and/or milled with the alloy and the oxide component. Alternatively, in other embodiments, the other portions described above are separately blended and milled. In one embodiment, the fabrication process forms the coating composition having a binder, a hard particle, and a lubricant, such as NiCr, $Cr_3Cr_2$, and $NiOB_2O_3$, respectively.

In one embodiment of the fabrication process, constituent materials of a precursor form of the coating are converted in situ to final phase by using the heat treatment techniques. Stated another way, in one embodiment, a matrix is formed as well as additives, in-situ. For example, a final composition (such as, WC—CO+Ag) is obtained by first blending WO3+4C to form a precursor. A constituent (such as, Ag) is deposited onto the composition using an application solution (such as, ammonical silver nitrate solution) and reducing agent (such as glucose solution). The reducing agent is used in a deposition bath for formation of the constituent (such as, the Ag). A component of the application solution (such as, $NO_3$) remains in solution and the constituent (such as, the Ag) is deposited onto particles of the precursor forming a bath solution. The bath solution is filtered then heated in an inert atmosphere (such as, an Argon atmosphere) to form the final phase (such as, WC—Co+Ag). In one embodiment, the fabrication process is consistent with one or both of the following equations:

$$WO_3+4C \rightarrow WC+3CO(g) \quad \text{(Eq. 1)}$$

$$\text{WC—Co+Ammonical silver nitrate} \rightarrow \text{WC—Co—Ag+} NH4NO_3(aq) \quad \text{(Eq. 2)}$$

In one embodiment of the fabrication process, the hard particles and the lubricating particles of the coating are chemically synthesized separately, for example, in fine form, to form a higher volume. The lubricating particles are dispersed within hard particles by solid state mixing. This provides dispersion of the lubricating particles and the hard particles. In one embodiment, the lubricant oxide component (NiO) is formed from precursor (for example, $Ni(NO_3)_2.6H_2O$ or $NiCl_2.6H_2O$) and the lubricant oxide is mixed with hard particles (for example, with T-400/Diamalloy 3002 particles) by solid state mixing. In one embodiment, the double oxide component (for example, $NiOB_2O_3$) is synthesized from the lubricating particles by using a water soluble precursor (for example, $Ni(NO_3)_2$.6H2O or $NiCl_2$.6H2O for oxide lubricant components with NiO or $H_3BO_3$ for oxide components with $B_2O_3$). From this mixed solution, the lubricant oxide component is precipitated (for example, using ammonium hydroxide solution and/or heated at about 600° C. for about 2 hours) and dried (for example, at about 900° C. for about 3 hours). In one embodiment, citric acid is added to the mixed solution to promote reaction.

In one embodiment of the fabrication process, the lubricating oxide component corrosion resistant particles are co-precipitated in-situ on the hard particles (matrix) from their respective precursors. This promotes inherent combination of properties on a single particle and, thus, substantially uniform properties across the microstructure of the coating and/or consistent performance of the coating, for example, even when the initial surface layers are subjected to a removal process in service.

In one embodiment of the fabrication process, the coating composition is spray dried to produce particles having desired flow characteristics and/or a d50 size (d50 size being an average equivalent diameter of the particles where half of the particles (by mass) have a larger equivalent diameter and half of the particles have a smaller equivalent diameter). The spray drying can be by any suitable spray drying process. For example, in one embodiment, spray drying includes atomization of a feed material (for example, the alloy, the oxide component and the lubricant) into a spray (for example, the coating composition), mixing and flow to produce spray air contact, drying of the spray by moisture removal, and separation of the dried product from the air. The characteristics of the dried product are determined by the physical and chemical properties of the feed, and by the conditions used in each stage of the process.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A cold sprayed coating, comprising:

a coating composition including:

an alloy selected from the group consisting of cobalt-based alloys, aluminum bronze alloys, and combinations thereof;

an oxide component comprising nickel oxide; and lubricating particles;

a cold-sprayed microstructure including compressive residual stresses;

a coefficient of friction less than about 0.43; and a wear rate of less than about 0.0005 $N/mm^3$.

2. The cold sprayed coating of claim 1, wherein the alloy includes $Co_{28}Mo_8Cr_2Si$.

3. The cold sprayed coating of claim 1, wherein the alloy includes $Co_{28}Mo_{17}Cr_2Si$.

4. The cold sprayed coating of claim 1, wherein the alloy forms, by volume, between about 5% and about 95% of the coating composition.

5. The cold sprayed coating of claim 1, wherein the oxide component further comprises one or more of titanium oxide and boron oxide.

6. The cold sprayed coating of claim 1, wherein the oxide component forms, by volume, between about 5% and about 30% of the coating composition.

7. The cold sprayed coating of claim 1, wherein the oxide component has a particle size range between about 10 nm and about 500 nm.

8. The cold sprayed coating of claim 1, wherein the oxide component is positioned on an article and has an anodic relationship with the article.

9. The cold sprayed coating of claim 1, wherein the lubricating particles comprise a material selected from the group consisting of hexagonal boron nitride, graphite, molybdenum disulfide, tungsten sulfide, cryolite, calcium difluoride, barium difluoride, mica, talc, calcium sulfate, polytetrafluoroethylene, and combinations thereof.

10. The cold sprayed coating of claim 1, wherein the lubricating particles form, by volume, between about 5% and about 20% of the coating composition.

11. The cold sprayed coating of claim 1, wherein the lubricating particles have a particle size range between about 50 nm and about 1000 nm.

12. The cold sprayed coating of claim 1, further comprising a ceramic, the ceramic being selected from the group consisting of tungsten carbide, titanium carbide, chromium carbide, and combinations thereof.

13. The cold sprayed coating of claim 1, further comprising a ceramic, the ceramic having a particle size range of less than about 500 nm.

* * * * *